United States Patent [19]

Lee

[11] 4,354,723

[45] Oct. 19, 1982

[54] ELECTRIC PLUG

[76] Inventor: Hop Lee, 2455 - 24th Ave., San Francisco, Calif. 94116

[21] Appl. No.: 211,429

[22] Filed: Nov. 28, 1980

Related U.S. Application Data

[63] Continuation-in-part of Ser. No. 63,393, Aug. 3, 1979, Pat. No. 4,293,178.

[51] Int. Cl.[3] ..... H01R 13/58; H01R 13/62

[52] U.S. Cl. ..... 339/103 R; 339/89 M

[58] Field of Search ..... 339/89 R-90 C, 339/103 R

[56] References Cited

U.S. PATENT DOCUMENTS 4,053,198 10/1977 Doyle et al. ..... 339/103 R

*Primary Examiner*—Eugene F. Desmond

*Attorney, Agent, or Firm*—Alvin E. Hendricson

[57] ABSTRACT

An electric plug having a threaded top cap has an internal spring loaded ratchet pin extending into engagement with tapered teeth about the inside of the cap and a manual pin retracting element on the outside of the plug body for removably locking the cap on the body and a ring and prong retainer for an electrical cord extending through the cap into the plug body.

4 Claims, 10 Drawing Figures

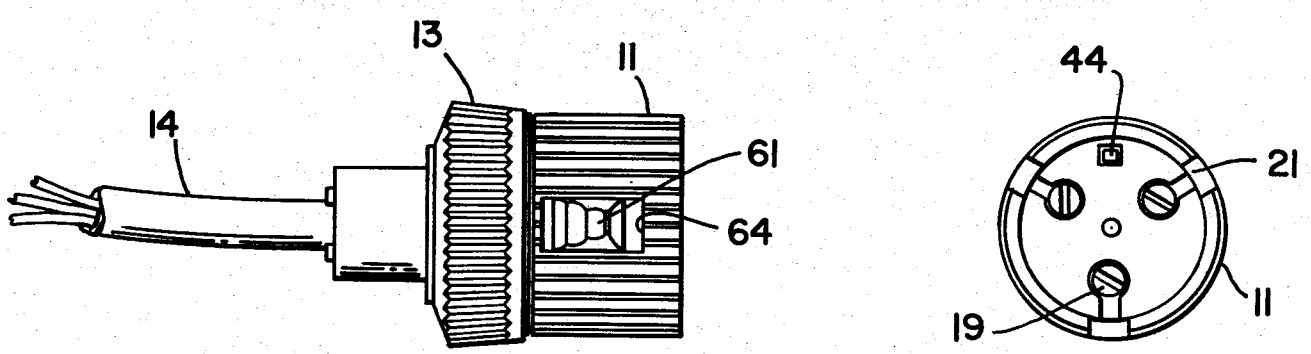
FIG_1
FIG_3
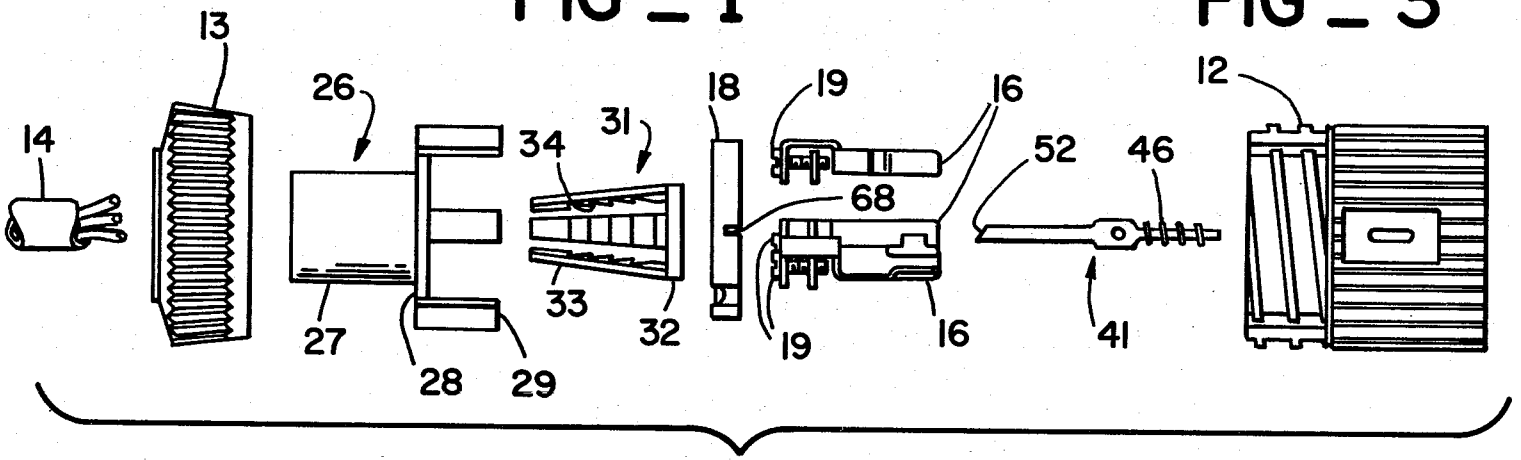
FIG_2

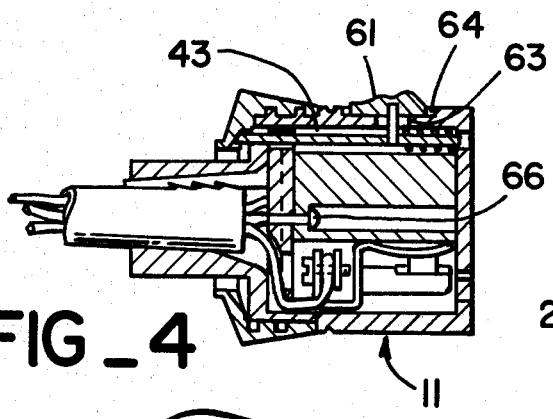
FIG_4
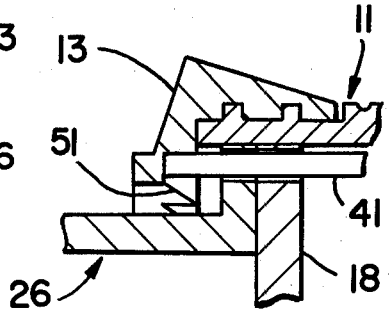
FIG_5
FIG_6
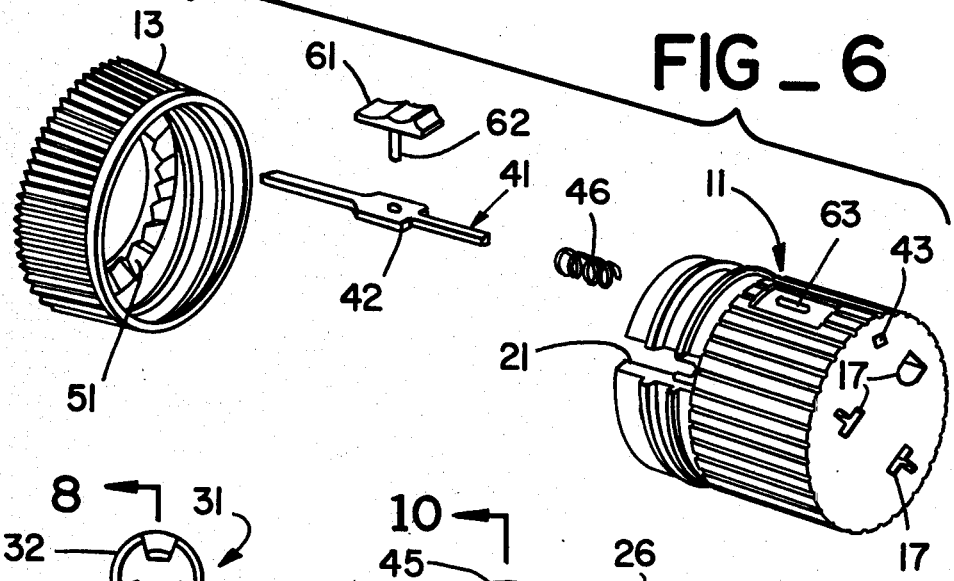
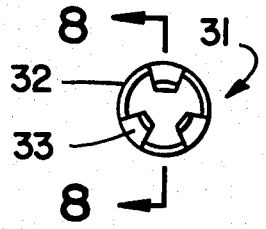
FIG_7
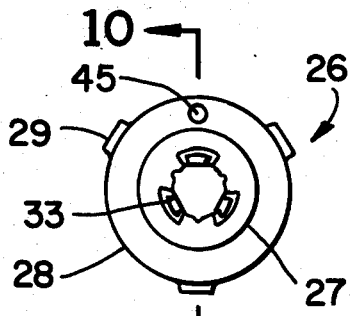
FIG_9
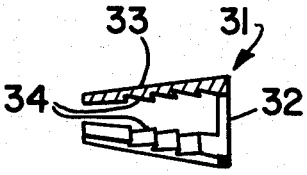
FIG_8
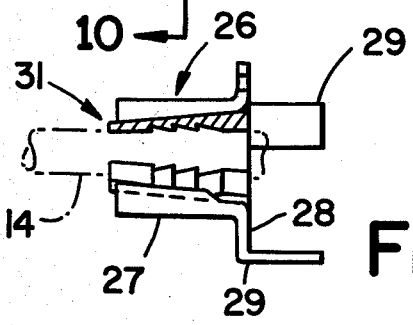
FIG_10

ELECTRIC PLUG

RELATED APPLICATIONS

This is a continuation-in-part of my prior copending U.S. Pat. Application No. 63,393 entitled, "Coupling for An Electric Cable" filed Aug. 3, 1979, now U.S. Pat. No. 4,293,178, issued Oct. 6, 1981.

BACKGROUND OF INVENTION

Electrical plugs have been formed in a wide variety of configurations and the present invention is an improvement on the type shown, for example, in my prior U.S. Pat. Nos. 4,081,206, 4,169,640, 4,173,383, 4,174,874 and 4,178,056. Such a plug has a top cap through which an electrical cord or cable extends and which is threaded on to the top or rear of the plug body to hold the plug elements together. While this type of construction has many advantages it has been found that the cap may become unscrewed in use of the plug and that the cord clamping elements may be difficult to align in plug assembly.

The present invention provides an improved electrical plug having releasable cap locking means and a readily inserted cord gripping means.

SUMMARY OF INVENTION

The present invention provides improvements in the structure of an electrical plug having a threaded cap retaining the plug elements within the plug body. A ratchet pin is slidably disposed in the plug body with spring means urging the pin longitudinally out of the rear of the body in position to engage inclined teeth formed about an interior shoulder of the cap for locking the cap against unthreading. A manually operable pin release is slidably disposed in an exterior slot in the plug body and is attached to the ratchet pin for depressing the pin to unlock the cap for removal of the latter from the plug body.

The improved plug hereof also includes cord gripping means having a plurality of limitedly flexible fingers with facing serrations and extending from a ring through which a cord extends. A tapered longitudinal passage in a rear plug member receives the gripping means which are compressed thereby to firmly engage the cord and retain same in the plug.

BRIEF DESCRIPTION OF FIGURES

The present invention is illustrated as to a single preferred embodiment in the accompanying drawings wherein:

FIG. 1 is a side elevation of a plug in accordance with the present invention;

FIG. 2 is an exploded view of the plug of FIG. 1;

FIG. 3 is a rear elevational view of the plug with cap, collar and cord removed;

FIG. 4 is a central longitudinal sectional view of the plug;

FIG. 5 is an enlarged partial sectional view showing the engagement of cap and locking pin;

FIG. 6 is a perspective view of the plug body, cap and locking means;

FIG. 7 is an end elevational view of the cord gripping member of the plug;

FIG. 8 is a sectional view taken in the plane 8—8 of FIG. 7;

FIG.9 is an end elevational view of the rear retaining collar of the plug; and FIG. 10 is a sectional view taken in the plane 10—10 of FIG. 9 with the cord gripping means inserted in the collar.

DESCRIPTION OF PREFERRED EMBODIMENT

The electrical plug of the present invention includes a cylindrical body portion 11 having threads 12 about the rear exterior thereof for receiving an internally threaded cap 13 through which an electrical cable 14 extends into the plug. Interiorly of the plug body 11 there are provided electrical terminals 16 fitting in recesses in the body and aligned with front aperture 17 so that prongs from a male plug may be inserted therein. An insulating plate 18 fits into a rear cylindrical recess in the plug body 11 upon the back end of the electrode 16 with apertures therethrough for access to bolts in binding posts 19 on the rear of the electrodes. The plate 18 is peripherally slotted to mate with logitudinal slots 21 in the threaded portion of the body 11 in alignment with the electrodes 16.

A retaining collar 26 is provided as a hollow cylinder 27 having a flange 28 extending about the inner end thereof and circumferentially spaced tabs 29 extending from the flange 28 away from the cylinder 27. These tabs 29 are adapted to fit into the slots 21 of the plug body 11 and the flange 28 is dimensioned to fit into the recess in the rear of the plug body with the underside of the flange 28 bearing upon the insulating plate 18.

Cable gripping means 31 are provided for location within the hollow cylindrical portion 27 of the collar 26. These gripping means 31 include a ring 32 having tapered fingers 33 extending from an upper surface thereof and inclined inwardly toward the axis of the ring, as shown in FIGS. 2 and 8. The gripping means 31 is formed of a limitedly flexibly material such as a plastic so that the fingers 33 may be resiliently deflected and the inner surface of each of the fingers 33 is formed with a toothed configuration 34, as illustrated, for gripping the surface of a cable 14 extended through the gripping means. Considering further the connection of cable and plug and referring to FIGS. 7 through 10 it will be seen that the retaining collar 26 has a slotted tapered opening therethrough adapted to receive the gripping means 31 and to deflect the fingers 33 thereof radially inward as the gripping means is forced into the collar cylinder. A cable 14 is extended through the collar 26 and gripping means 31 with the conductors of the cable then being connected to the binding posts 19. The gripping means 31 is then oriented to align the fingers thereof with the slots in the interior of the collar and the collar is urged onto and into the rear end of the plug body 11 with the tabs 29 extending into the slots 21 in the body. The cap 13 fits over the cylindrical portion 27 of the collar 26 and is then threaded onto the rear of the plug body to force the collar tightly into the body and, consequently, to force the gripping means 31 into the collar inasmuch as the ring 32 of the gripping means rests against the insulating plate 18. This will then cause the toothed fingers 33 of the gripping means to be compressed against the exterior of the cable 14 for locking the cable in the plug.

It will be appreciated from the foregoing description that the cap 13 holds the elements of the plug within the plug body and the present invention provides means for insuring tightly threaded engagement of cap and body. In this respect reference is made particularly to FIGS.

4, 5 and 6 wherein there will be seen to be provided a ratchet pin 41 having a shoulder 42 at a distance from the inner end thereof and slidably disposed in the longitudinal opening 43 in the plug body 11. An aligned opening 44 is provided in the insulating plate 18 so that the upper end of the pin 41 extends therethrough and a spring 46 is disposed about the inner end of the pin 41 within the opening 43 beneath the shoulders 42 to urge the pin toward the rear of the plug and the pin and opening cooperate to prevent rotation of the pin. There is also provided an aligned opening 45 in the flange 28 of the retaining collar 26 so that the ratchet pin 41 may extend therethrough.

The threaded cap 13 has an internal flange at the rear thereof about the central opening through which the collar 26 extends and the undersurface of this flange is formed with ratchet teeth 51 for engagement with the outer end of the ratchet pin 41 which is preferrably tapered, as indicated at 52 of FIG. 2. The pin 41 is mounted in the plug body in alignment with the ratchet teeth 51 on the cap 13 which have one straight side and one inclined side so that the cap may be rotated for threading onto the plug while depressing the pin with each of the teeth but may not be unthreaded because the pin end engages a straight side of a tooth when the cap is attempted to be rotated in the opposite direction. It will, of course, be appreciated that the cap and plug body may have right or lefthanded threads thereon so that the ratchet teeth and pin are appropriately formed to accept rotation of the cap threaded onto the plug body and to prevent rotation of the cap for unthreading from the plug body. It will be seen that with this structure, the cap will be retained in tightly threaded engagement on the plug body to hold the retaining collar 26 within the plug so that inadvertant unthreading of the cap will not occur during use.

The present invention furthermore provides for releasing the cap so that it may be removed if desired. Such means includes a slide tab 61 joined by a connecting pin 62 to the ratchet pin 41 through a slot 63 in the side of the plug body 11. The tab 61 fits in a recess 64 on the exterior of the plug body and is slidably disposed therein so that the tab 61 may be manually slid in the recess 64 to retract the ratchet pin 41 against the pressure of the spring 46 and thus release the cap 13 so that it may be unthreaded from the plug body. The tab 61 may have transverse ridges or the like on the outer surface thereof to facilitate movement of same by finger pressure. In order to remove the cap 13 from the body 11 it is only necessary to depress or slide the tab 61 to retract the ratchet pin 41 and then to rotate the cap and unthread it from the body. When the cap is threaded onto the body it will hold the retaining collar 26 in position with the gripping means 31 compressed therein to grip the cable and the cap will be locked in this position. Consequently, forces that may be applied to the cable or the rear of the plug will not loosen the cap engagement with the plug body, for the ratchet pin prevents rotation of the cap to unscrew the latter from the body.

The structure of the electric plug of the present invention is in part conventional as shown, for example, in my above-noted prior patents and co-pending patent application; however, the present invention does provide specific improvements therein which materially enhance the applicability of the plug and improve the performance thereof. Various structural details of the present invention are subject to modification and variation and thus, for example, the insulating plate 18 may be bolted or rivited through the plug body, as indicated at 66 and the connecting pin 62 may be formed integrally with the slide tab 61 so that it can be snapped into the ratchet pin 41 during fabrication of the present invention. Similarly, the electrodes 19 may be formed of a variety of different configurations depending upon the types of connections to be made with a male plug and it will be appreciated that the binding posts 19 may be similar to those illustrated in my U.S. Pat. No. 4,081,206 for example. It is also noted that the insulating plate 18 is preferrably formed for ready orientation in the body recess of the plug as, for example, by the provision of a slot 68 across the underside thereof mating with a ridge across the bottom of the recess in the plug body. This then provides for proper alingment of the insulating plate when it is inserted in the plug body during fabrication of the plug itself.

Although the present invention has been described above with respect to a single preferred embodiment thereof, it will be appreciated by those skilled in the art that numerous modifications and variations are possible within the scope of the present invention and thus it is not intended to limit the invention to the precise details of illustration or terms of description.

What is claimed is:

1. An improved electrical plug having a body with a cap threaded on the rear thereof and engaging a retaining collar about an electric cord comprising a ratchet pin slidably mounted in said body and having a spring urging the pin outwardly from the rear of the body, said cap having interior ratchet teeth facing said body in position for engagement with said ratchet pin whereby said pin rides over said teeth during threading of the cap on the body and locks with said teeth for reverse cap rotation, and release means extending exteriorly of said body for depressing said ratchet pin to retract same from engaging the teeth on said cap and release the cap for unthreading from the body.

2. The improved plug of claim 1 further defined by said release means including a tab slidably disposed in an exterior recess on said body and being connected through a slot in said body to said ratchet pin for manual retraction of the pin against spring pressure.

3. The improved plug of claim 1 further defined by said ratchet pin having a rectangular cross section fitting a rectangular body opening for preventing pin rotation and said pin having at least one shoulder thereon engaging a spring compressed against a portion of said body for urging an end of the pin toward said cap to engage the ratchet teeth thereon.

4. The plug of claim 1 further defined by said retaining collar having a tapered axial opening therethrough and a flange thereabout adapted to fit into a rear body recess and to engage the underside of said cap as the cap is threaded onto said body, and gripping means having a ring with limitedly flexible fingers having facing serrated surfaces extending from one side thereof and fitting into said collar opening for compression of said fingers against an electric cord extending therethrough as said gripping means is forced into said collar by said cap being threaded onto said body.

* * * * *